US005992693A

United States Patent [19]

Albisetti

[11] Patent Number: 5,992,693

[45] Date of Patent: Nov. 30, 1999

[54] DEVICE FOR PACKAGING TWO COMPONENTS

[75] Inventor: Nicolas Albisetti, Clichy, France

[73] Assignee: L'Oreal, Paris, France

[21] Appl. No.: 09/104,405

[22] Filed: Jun. 25, 1998

[30] Foreign Application Priority Data

Jul. 8, 1997 [FR] France ..... 97 08663

[51] Int. Cl.[6] ..... B65D 25/08; B67O 5/56

[52] U.S. Cl. ..... 222/129; 206/221; 215/DIG. 8

[58] Field of Search ..... 222/129, 136, 222/383.1; 206/219, 568, 221; 215/6, DIG. 8

[56] References Cited

U.S. PATENT DOCUMENTS 5,613,623 3/1997 Hildebrandt ..... 222/129
5,875,889 3/1997 Albisetti ..... 222/129

FOREIGN PATENT DOCUMENTS 2 691 950 12/1993 France .
2 707 601 1/1995 France .
44 36 863 C 1 1/1996 Germany .
WO 88/09021 11/1988 WIPO .

*Primary Examiner*—Kevin Shaver
*Assistant Examiner*—John P. Welsh
*Attorney, Agent, or Firm*—Oliff & Berridge, PLC

[57] ABSTRACT

A device for separately packaging two components to be mixed together on first use, and for dispensing the resulting mixture, the device being of the type comprising two superposed containers suitable for communicating with each other via a passage and capable of rotating relative to each other about an axis of rotation without moving axially, a single shutter disposed in said passage to close it during separate storage of the components, one of the containers further including a guide mechanism for guiding displacement of the shutter in said passage and the other container including a drive mechanism for transforming relative rotation of the two containers into axial displacement of the shutter in the guide mechanism, thereby opening the passage. The shutter further includes a retaining mechanism suitable for limiting its displacement in the guide mechanism at the end of relative rotation of the containers.

12 Claims, 8 Drawing Sheets

DEVICE FOR PACKAGING TWO COMPONENTS

FIELD OF THE INVENTION

The present invention relates to a device for separately packaging two components that are to be mixed on first use, and for dispensing the resulting mixture.

More particularly, the invention relates to a device comprising two superposed containers suitable for communicating with each other via a passage and capable of turning one relative to the other about an axis of rotation without moving axially, a single shutter disposed in said passage to close it during separate storage of the components, one of the containers further including guide means for guiding displacement of the shutter in said passage, and the other container including drive means for transforming relative rotation of the two containers into axial displacement of the shutter in said guide means, thereby causing the passage to be opened and the components to be mixed.

BACKGROUND OF THE INVENTION

This type of device makes it possible to mix components without reducing volume, and thus without setting up excess pressure liable to squirt the mixture out through the opening.

Japanese utility model 2 503 369 discloses a device of that type, in which the shutter drops to the bottom of the lower container at the end of relative rotation between the two containers. The shutter can then become caught in the passage if the device is turned over, thereby impeding dispensing of the mixture, particularly if the mixture is viscous.

Also, French patent application No. 2,691,950discloses a device with two containers including a moving shutter which, at the end of its displacement, bears against a shoulder of an actuator member mounted on the upper container. In that device, the above-mentioned drawback does not exist. However, the shutter extends over substantially the full height of the upper container and turns out to be expensive to produce if said container is large in size. The relatively great length of the shutter also gives rise to considerable twisting thereof during actuation, and that can lead to jamming. In addition, the shutter is screwed at its bottom end onto a chimney which co-operates with the upper container to form a groove in which the component contained therein can be retained without mixing with the other component.

German patent DE 44 36 863 C1 discloses a two-container device that is relatively complex in structure, having two shutters which move apart from each other during relative rotation of the containers.

OBJECTS AND SUMMARY OF THE INVENTION

An object of the present invention is to provide a novel device enabling the above-mentioned drawbacks to be remedied in full or in part.

The invention achieves this by the shutter including retaining means suitable for limiting its axial displacement in said guide means at the end of relative rotation between said containers.

Because of the invention, the shutter is prevented from impeding the flow of the mixture while the mixture is being dispensed, and its cost of manufacture is substantially independent of the size of the containers since it does not need to extend over the full height of either of them. In addition, the above-mentioned problem of jamming associated with twisting of the shutter no longer arises.

In a particular embodiment of the invention, the guide means are shaped to guide the shutter in translation.

In a particular embodiment, the guide means include a narrow portion that does not constitute a body of revolution, formed in the passage.

The shutter then preferably includes a shank shaped to co-operate with the guide means, and the retaining means are constituted by at least one portion in relief projecting from an end of the shank.

In another particular embodiment, the shutter has a skirt with recesses shaped to co-operate with the guide means, and the retaining means are constituted by the material of the skirt at the ends of the recesses.

In another particular embodiment, the guide means include grooves shaped to guide sliding of shutter tabs, and the retaining means are constituted by a ring interconnecting said tabs.

In a particular embodiment of the invention, the drive means comprise at least one thread which, in a particular configuration, can be formed on a ring secured to one of the containers, or in a variant, can be directly molded integrally on one of the containers.

In another particular embodiment, the drive means comprise a helical ramp shaped to bear progressively against the shutter when the two containers are rotated, one relative to the other.

In another particular embodiment, the shutter includes a compartment designed to contain a third component and the device further includes a perforated transverse wall in the passage whereby the two containers communicate, which wall is shaped to close said third compartment while the shutter is initially in place in the passage.

By way of example, the third component may be a perfume or fragrance that is mixed with the other two components on first use of the device.

BRIEF DESCRIPTION OF THE DRAWINGS

Other characteristics and advantages of the present invention appear on reading the following detailed description of non-limiting embodiments of the invention, and on examining the accompanying drawings, in which.

MORE DETAILED DESCRIPTION

Figure 1:
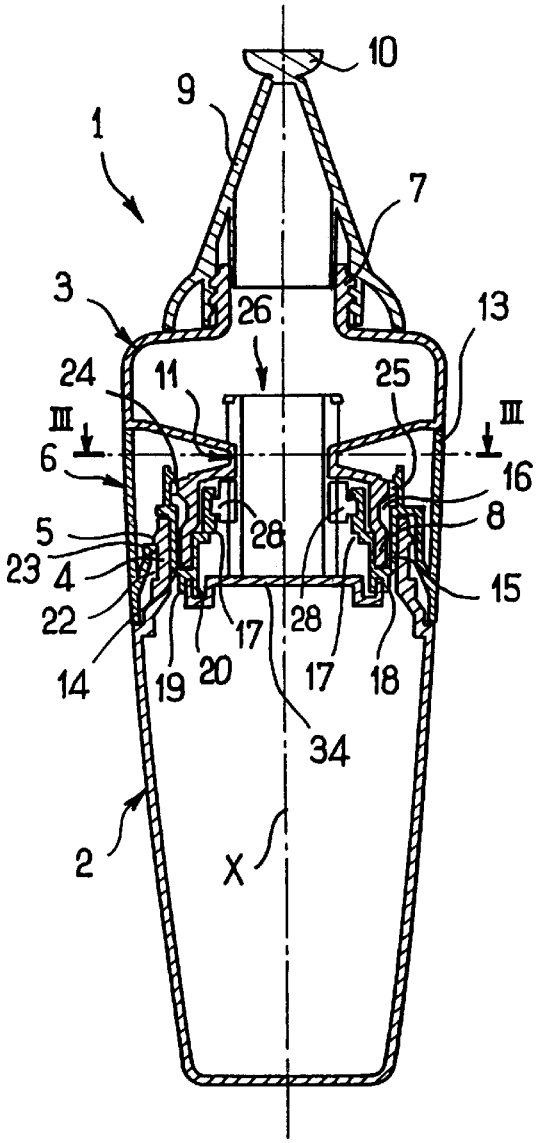
FIGS. 1 and 2 show a device constituting a first embodiment of the invention, respectively before and after the components have been mixed.
Figure 2:
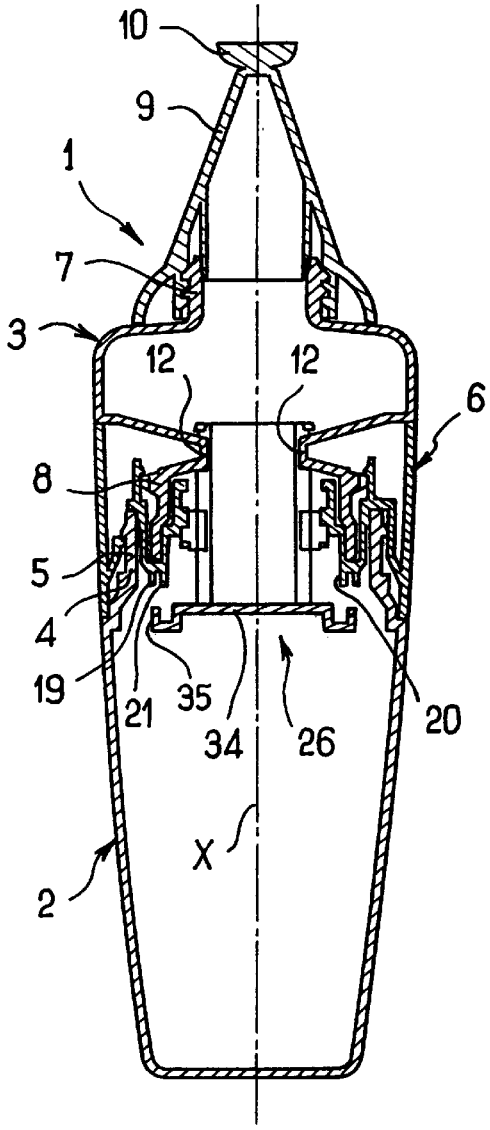

FIGS. 1 and 2 show a device 1 constituting a first embodiment of the invention.

The device 1 comprises a lower container 2 and an upper container 3 capable of turning relative to each other about an axis of rotation that coincides with the longitudinal axis X of the device.

The top portion of the lower container 2 has a neck 4 provided with an annular bead 5 on which a ring 6 snap-fastens.

The top portion of the upper container 3 has a threaded neck 7, and its bottom portion 8 is partially engaged in the neck 4.

A dispenser endpiece 9 having a snap-off end 10 is screwed onto the neck 7.

The bottom portion 8 is connected to the remainder of the upper container 3 via a narrow portion 11 that does not constitute a body of revolution about the axis X.

Figure 3:
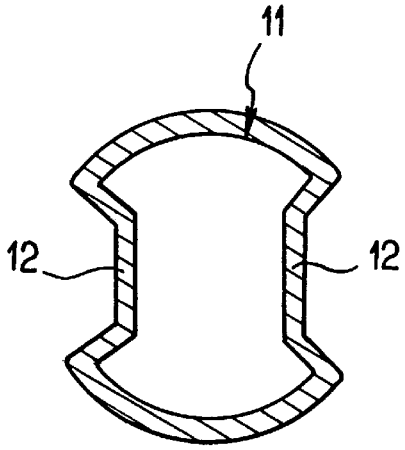
FIG. 3 is a cross-section through the upper container on section line III—III of FIG. 1.
Figure 4:
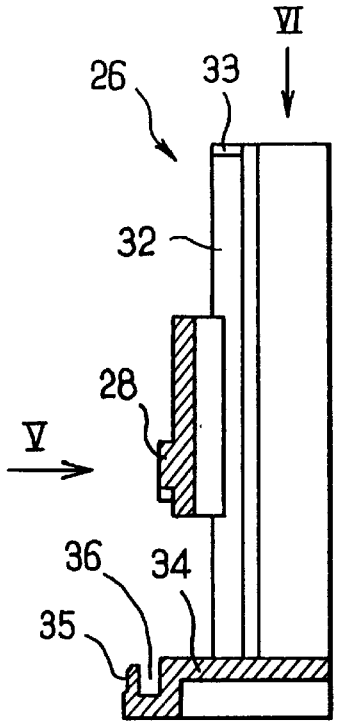
FIG. 4 is a diagrammatic and fragmentary axial section of the shutter shown in FIGS. 1 and 2.
Figure 5:
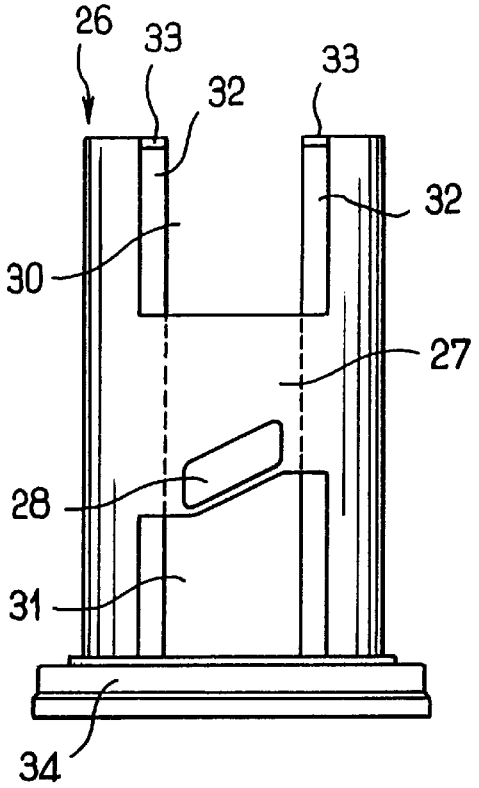
FIG. 5 is a side view as seen on arrow V of FIG. 4.
Figure 6:
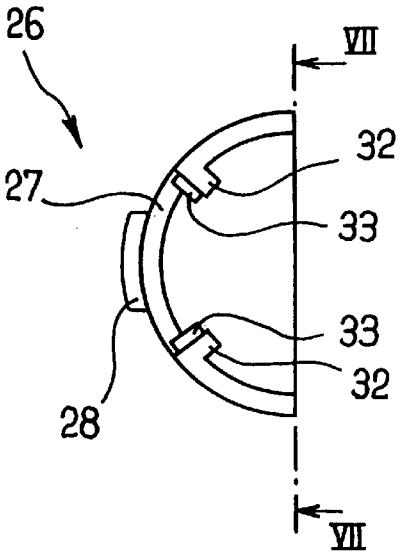
FIG. 6 is a plan view as seen on arrow VI of FIG. 4.
Figure 7:
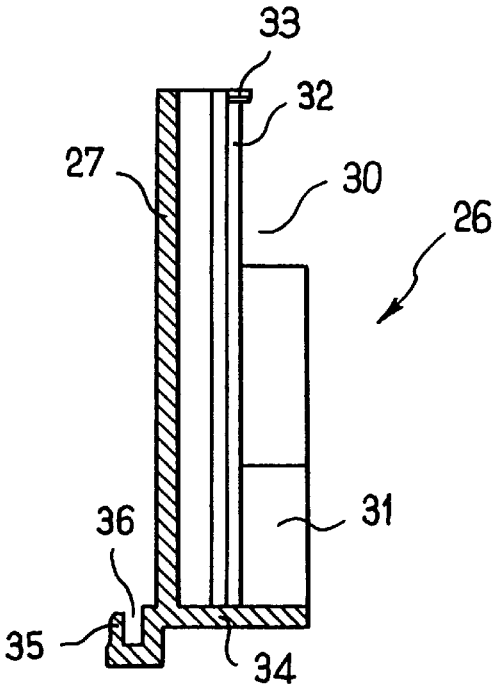
FIG. 7 is a fragmentary section on section line VII—VII of FIG. 6.
Figure 8:
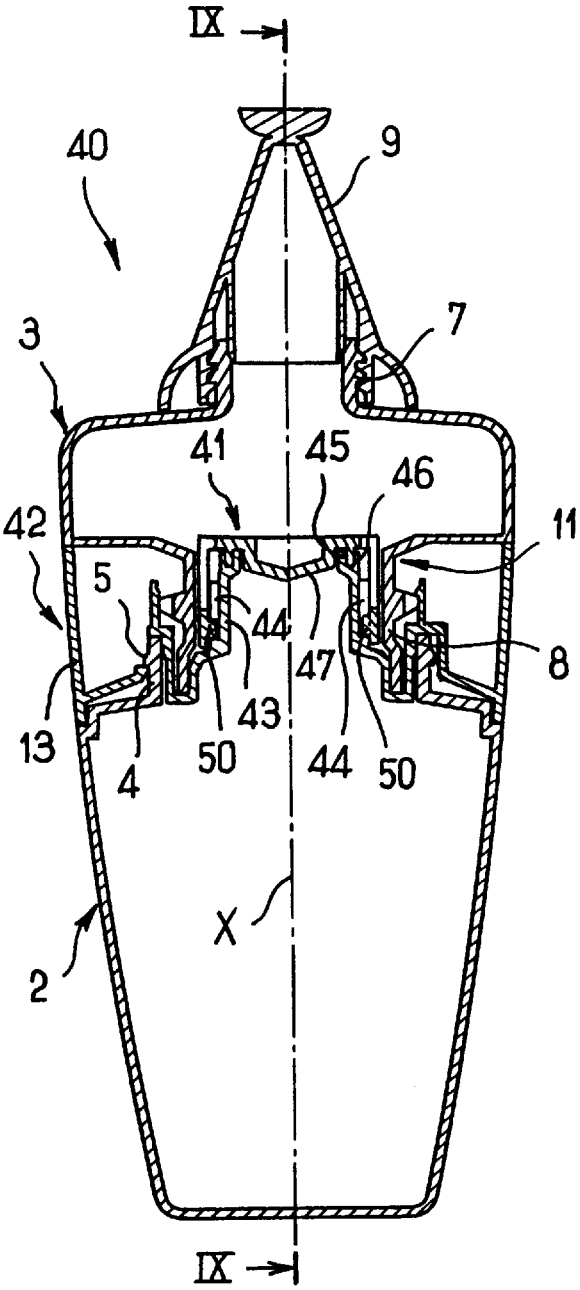
FIG. 8 is a diagrammatic longitudinal section through a device constituting a second embodiment of the invention, prior to mixing of the components.
Figure 9:
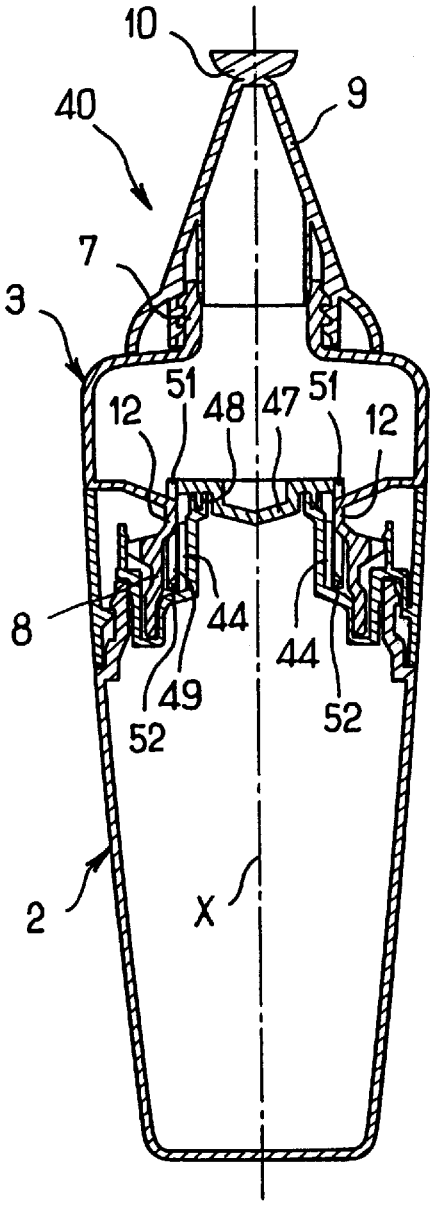
FIG. 9 is a view on section line IX—IX of FIG. 8.

More particularly, as shown in FIG. 3, the narrow portion 11 has two diametrically opposite indentations 12.

The ring 6 has an outer skirt 13 and two concentric skirts 14 and 15 which are interconnected by a wall 18 forming an upwardly-open annular groove 16 in which the bottom portion 8 of the upper container 3 is engaged.

The inner skirt 14 has two threads 17 on its radially inner face, each extending over a little less than half a turn about the axis X and being disposed symmetrically relative to the other about said axis.

The threads 17 constitute drive means within the meaning of the present invention, as explained in greater detail below.

The wall 18 which constitutes the bottom of the above-mentioned groove 16 is extended downwards by two annular sealing lips 19 and 20 which leave between them an annular groove 21.

The intermediate skirt 15 is connected to the outer skirt 13, thereby forming a downwardly open annular groove 22 in which the neck 4 is engaged.

Portions in relief 23 surmounted by recesses are formed in the wall whereby the intermediate skirt 15 is connected to the outer skirt 13 so as to snap-fasten onto the annular bead 5. Where appropriate, the portions in relief 23 may also prevent the ring 6 from rotating relative to the lower container 2.

At its top end, and on its radially inside surface, the intermediate skirt 15 also includes an annular bead 24 which retains by snap-fastening teeth 25 that project from the radially outer surface of the lower portion 8 of the upper container 3.

The upper container 3 bears against the top edge of the outer skirt 13 so as to enable it to rotate relative thereto without moving axially along the axis X.

A shutter 26 serves to separate the components respectively contained in the lower container 2 and in the upper container 3 until first use of the device 1.

These two components are not shown in the drawings for reasons of clarity.

They may be constituted by two liquids or by a liquid and a powder.

By way of example, one of the components may be constituted by an oxidizing agent and the other by a coloring agent which, when mixed with the oxidizing agent, forms a hair dye.

The lower and upper containers are made of materials that are chemically compatible with the components. The upper container may be made, for example, out of poly-vinyl chloride, the lower container out of polyethylene, and the shutter out of polypropylene.

The shutter 26 is shown in isolation in FIGS. 4 to 7.

The shutter 26 comprises a hollow shank 27 provided about half-way up on its radially outer surface with two diametrically opposite studs 28 that are shaped so as to engage in the threads 17.

At its top end and at its bottom end, the shank 27 has openings 30 and 31 designed respectively to co-operate with the indentations 12 and to enable the components contained in the upper container 3 to flow towards the lower container 2 on first use of the device.

The shank 27 is also provided with internal longitudinal ribs 32 situated along the longitudinal edges of the openings 30 and 31.

The top ends of the ribs 32 are provided with teeth 33 constituting retaining means within the meaning of the present invention, suitable for bearing against the top edges of the indentations 12 of the narrow portion 11 so as to prevent the shutter 26 from falling into the lower container 2, as explained below.

The bottom end of the shank 27 is connected to a plug 34 which is provided at its periphery with an annular sealing lip 35 which co-operates with the remainder of the plug to leave an annular groove 36.

When the shutter 26 is in its initial position within the device 1, the lip 35 engages in the groove 21 formed between the lips 19 and 20.

The device 1 is assembled as follows.

The shutter 26 is screwed into the inner skirt 14 until the lip 35 is inserted into the groove 21.

Thereafter, the upper container 3 is positioned over the ring 6, with the indentations 12 oriented so as to be engaged between the ribs 32. The upper container 3 is then lowered until it snaps onto the bead 24 of the intermediate skirt 15. The teeth 33 deform elastically to go past the indentations 12. The upper container 3 is filled with one of the components, and then the endpiece 9 is screwed onto it.

The lower container 2 is filled with the other component, and then the assembly constituted by the upper container 3 and the ring 6 is snap-fastened on the neck 4.

It may be observed that sealing between the ring 6 and the lower container 2 is provided by the intermediate skirt 15 which bears in sealed manner via its radially outer surface against the radially inner surface of the neck 4, and that sealing between the ring 6 and the upper container 3 is provided by the inner skirt 14 pressing via its radially outer surface against the radially inner surface of the lower portion 8.

To mix the components, a user turns the upper container 3 relative to the lower container 2 and the ring 6.

The shutter 26 turns with the upper container 3 because of the co-operation between the indentations 12 and the ribs 32.

The shutter 26 rotated in this way is moved downwards by the threads 17, with the ribs 32 sliding over the indentations 12 engaged in the openings 30.

The components contained in the upper container 3 can then reach the lower container 2 via the inside of the shank 27 and the openings 31.

It will be observed that the indentations 12 constitute guide means situated level with the passage via which the lower and upper containers 2 and 3 communicate.

It will also be observed that the shutter is of relatively short axial extent compared with the device described in above-mentioned earlier French patent application 2 691 950.

FIGS. 8 to 11 show a device 40 constituting a second embodiment of the invention.

The device 40 has certain component parts that are identical to those of the above-described embodiment, which parts are not described again and are given the same references.

The device 40 differs from the preceding device essentially by the shape of the shutter, referenced 41, and by the shape of the inner skirt, referenced 43.

The ring snapped onto the lower container 2 is now referenced 42.

The shutter 41 is moved upwards when the upper container 3 is rotated relative to the lower container 2 for the purpose of mixing the components together.

The inner skirt 43 has two threads 44 on its radially outer face, and two annular sealing lips 45 and 46 that are concentric at its top end.

The threads 44 are symmetrical to each other about the axis X and they constitute the drive means within the meaning of the present invention.

The top portion of the shutter 41 has a plug 47 provided with an annular sealing lip 48 designed to engage in the groove formed between the Lips 45 and 46, while the components are being stored separately.

The plug 47 is extended downwards at its periphery by a skirt 49 provided at two diametrically opposite locations on its radially inner surface with studs 50 each adapted to engage in a respective thread 44.

The skirt 49 has two diametrically opposite recesses 51 in which the indentations 12 of the upper container 3 engage.

In this way, the shutter 41 is prevented from rotating relative to the upper container 3 while nevertheless being capable of moving axially relative thereto.

The recesses 51 do not extend as far as the bottom end of the skirt 49, such that the regions 52 of the skirt 49 situated beneath these recesses 51 limit axial displacement of the shutter in an upwards direction and constitute retaining means within the meaning of the present invention.

The device 40 is assembled by screwing the shutter 41 onto the inner skirt 43 until sealing contact is obtained between the sealing lips 45, 46, and 48, and then the upper container 3 is snap-fastened in the ring 42.

After the upper container has been filled, the endpiece 9 is put into place and then the assembly is put onto the lower container 2 which has itself previously been filled.

Figure 10:
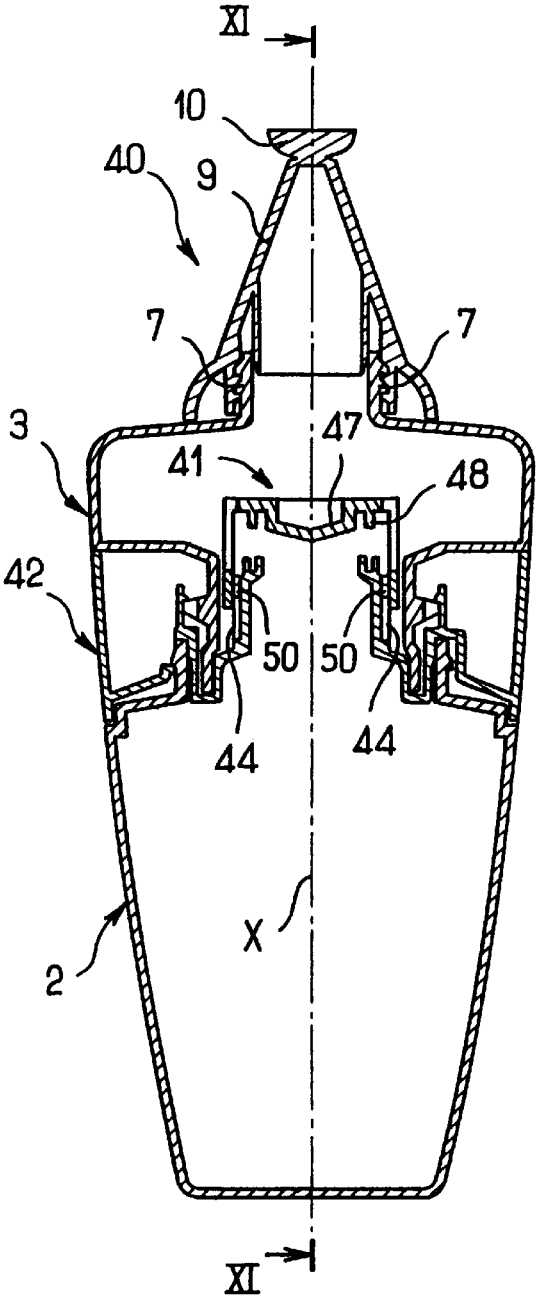
FIG. 10 is a view analogous to FIG. 8, showing the device after the components have been mixed together.
Figure 11:
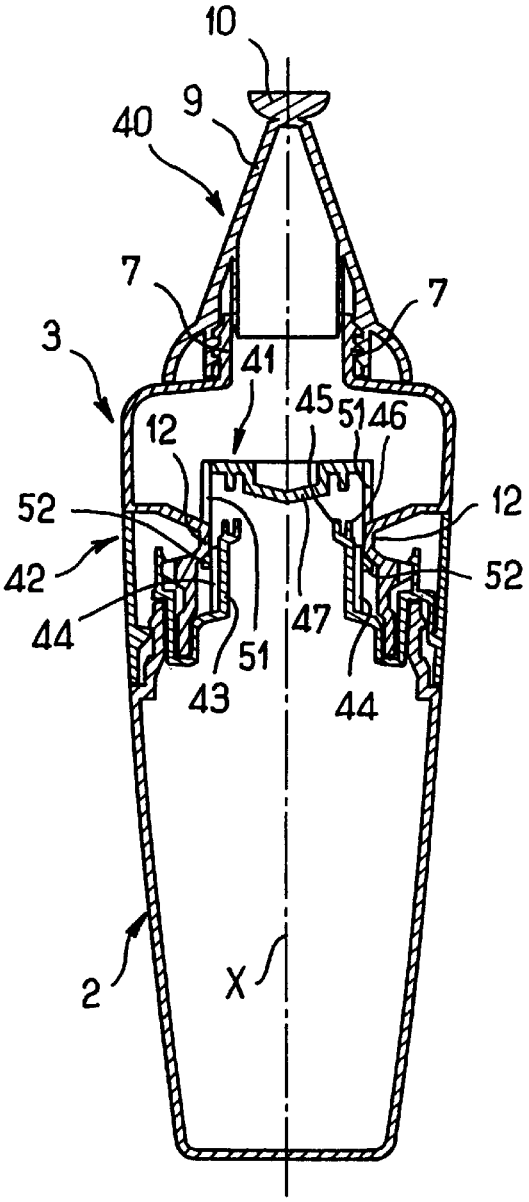
FIG. 11 is a view on section line XI—XI of FIG. 10.
Figure 12:
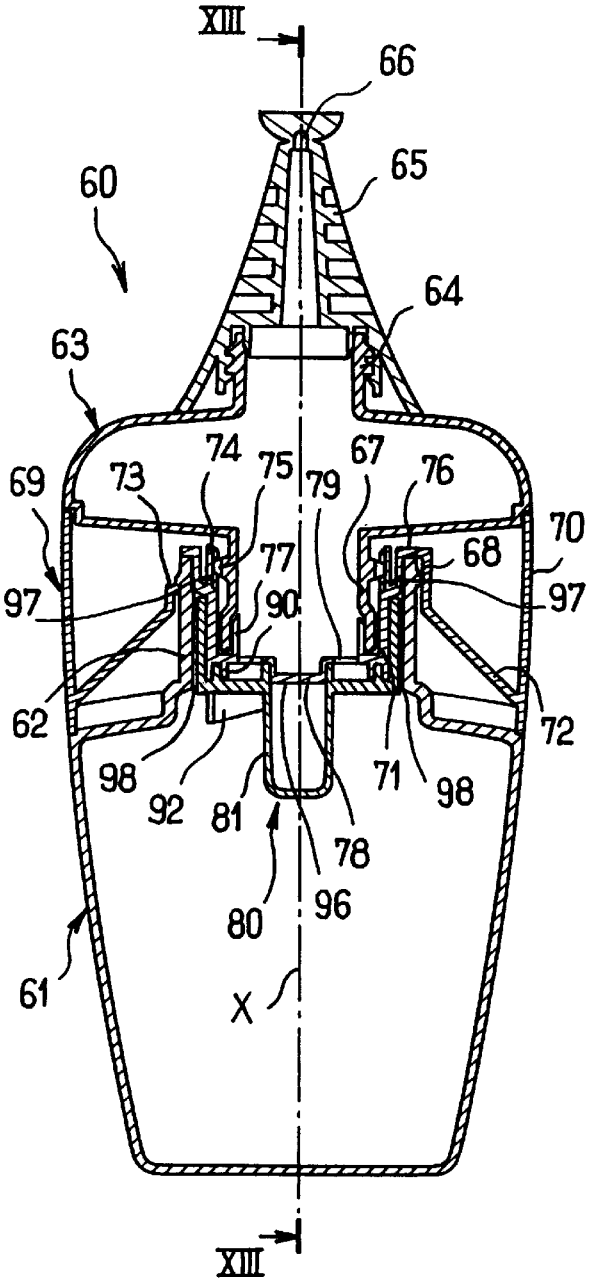
FIG. 12 is a diagrammatic longitudinal section of a device constituting a third embodiment of invention.
Figure 13:
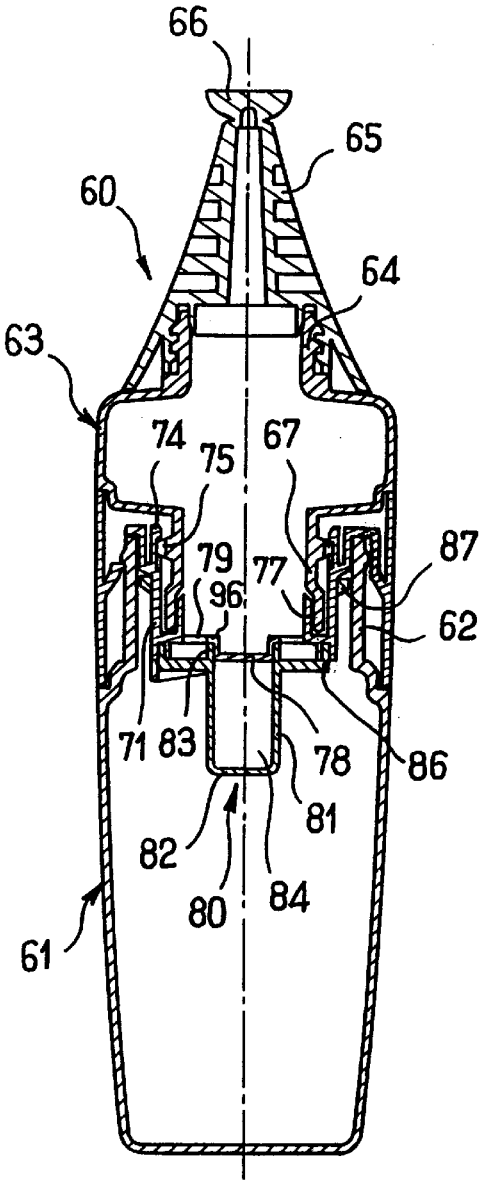
FIG. 13 is a view on section line XIII—XIII of FIG. 12.

In order to mix the components, the user turns the upper container 3 relative to the lower container 2, thereby rotating the shutter 41 in the threads 44 and causing it to be lifted until it takes up the position shown in FIGS. 10 and 11, with the regions 52 coming into abutment against the indentations 12.

The component contained in the upper container then flows via the recesses 51 into the lower container 2.

FIGS. 12 to 17 show a device 60 constituting a third embodiment of the invention.

The device 60 comprises a lower container 61 in the form of a flask provided with a neck 62. The upper container has, on top, a threaded neck 64 closed by a dispensing endpiece 65 provided with a snap-off portion 66.

The upper container 63 includes a lower portion 67 that is partially engaged in the neck 62 of the lower container 61.

In the vicinity of its top end, the neck 62 is provided with an annular bead 68 projecting radially outwards, and on which a ring 69 snap-fastens.

The ring has an outer skirt 69 and an inner skirt 71 which are interconnected by a substantially frustoconical wall 72 provided with portions in relief 73 that are surmounted by recesses, said portions in relief being designed to snap-fasten onto the annular bead 68.

The inner skirt 71 is engaged in the neck 62 and has an annular rim 76 that bears against the end wall thereof.

The inner skirt 71 is also provided at its top end and on its radially inner surface with an annular bead 74 on which there snap-fasten teeth 75 formed on the radially outer surface of the lower portion 67 of the upper container 63.

The upper container 63 bears against the outer skirt 70 so as to enable it to rotate relative to the lower container without moving axially.

Notches 97 are formed beneath the annular bead 74 to co-operate with the teeth 75 and prevent the upper container 63 from rotating relative to the ring 69.

The inner skirt 71 is closed at its bottom end by a transverse wall 78 carrying on its upper face an annular sealing lip 77 which bears in sealed manner against the radially inner surface of the lower portion 67 of the upper container 63.

A circularly cylindrical setback 96 about the axis X is formed in the center of the wall 78, and openings 79 are formed between said setback 96 and the lip 77.

Figure 17:
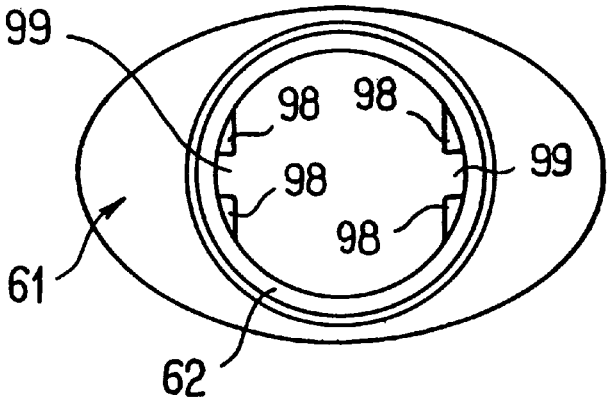
FIG. 17 is a plan view in isolation of the lower container of FIGS. 12 to 15.

At its base, the neck 62 has bearing surfaces 98 disposed so as to form two diametrically opposite grooves, as shown in FIG. 17.

A shutter 80 serves to keep separate the components contained respectively in the lower and upper containers prior to first use of the device 60.

Figure 16:
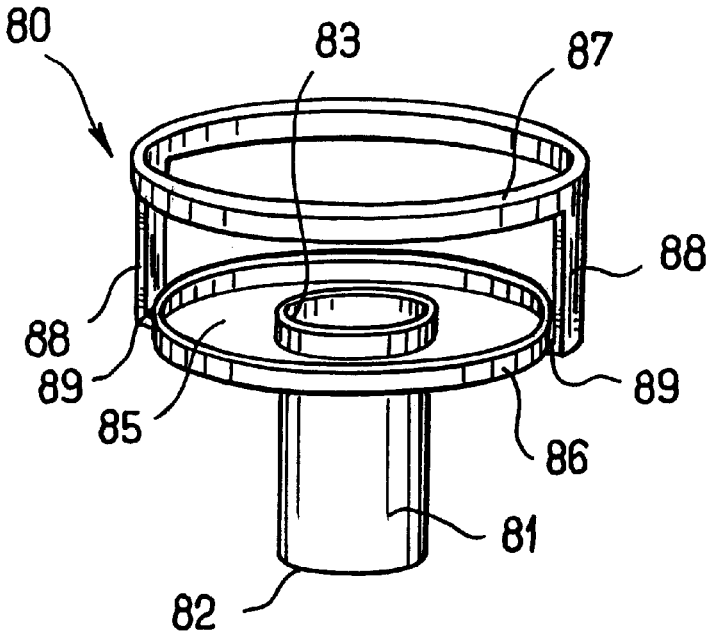
FIG. 16 is a perspective view in isolation of the shutter fitted to the device shown in FIGS. 12 to 15.

FIG. 16 shows the shutter 80 in isolation.

The shutter comprises a central shank 81 closed at its lower end 82 and provided at its upper end with an annular sealing lip 83 designed to bear in sealed manner while the shutter 80 is in its initial position against the periphery of the setback 96 so as to form a sealed compartment 84 suitable for containing a third component, e.g. a perfume or fragrance, stored without making contact with either of the other two components.

The shank 81 is extended radially outwards at the base of the annular sealing lip 83 by a transverse wall 85 provided at its periphery and on its top face with an annular sealing lip 86 that is concentric with the lip 83.

At its top portion, the shutter 80 includes a ring 87 of larger diameter than the transverse wall 85 and that is connected thereto by two diametrically opposite linking tabs 88.

Each of the tabs 88 co-operates with the annular sealing lip 86 to form a groove 89.

The inner skirt 71 has an annular sealing lip 90 which bears against the radially inner surface of the lip 86 to provide sealing between the ring 69, and the shutter 80.

The lower edge of the inner skirt 71 forms a helical ramp 92 extending over a little less than half a turn.

When the shutter 80 is in place, the ramp 92 lies outside the grooves 89.

When the user turns the upper container 63 relative to the lower container 61, the ramp 92 engages in one of the grooves 89 and presses against the bottom of the groove, thereby driving the shutter 80 downwards. The shutter is prevented from rotating by the tabs 88 which are held against rotation in the grooves 99 and which slide therein.

Figure 14:
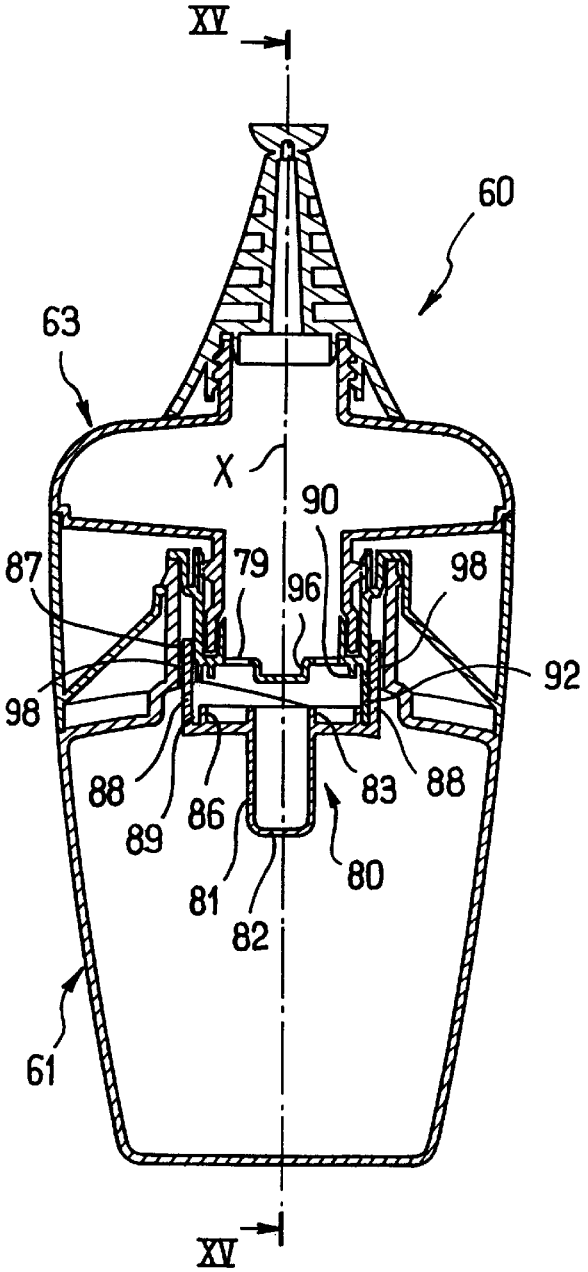
FIG. 14 is a view analog to FIG. 12, showing the device after the components have been mixed together.
Figure 15:
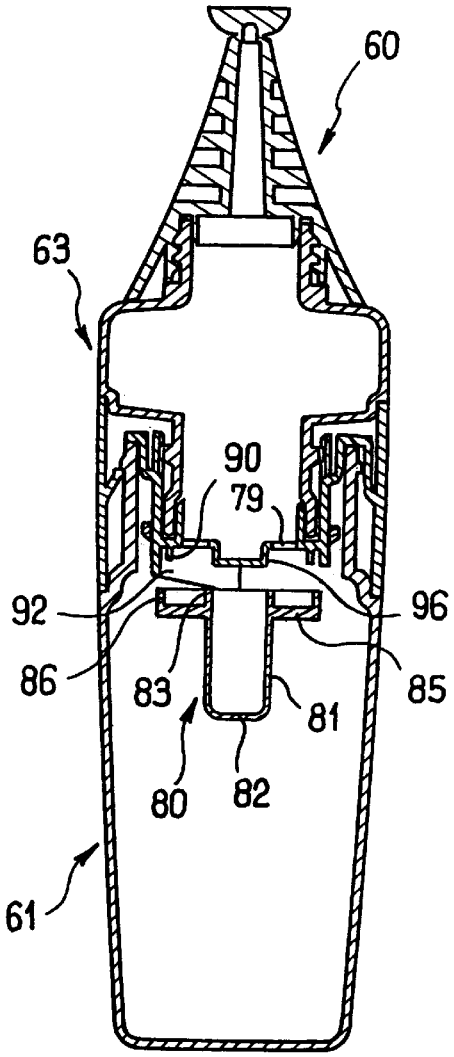
FIG. 15 is a view on section line XV—XV of FIG. 14.

FIGS. 14 and 15 show the device 60 after the two containers 61 and 63 have been rotated. The components contained in the upper container 63 can flow into the lower container via the openings 79. The components contained in the shutter 81 can leave the shutter when the device 60 is turned upside-down.

Figure 19:
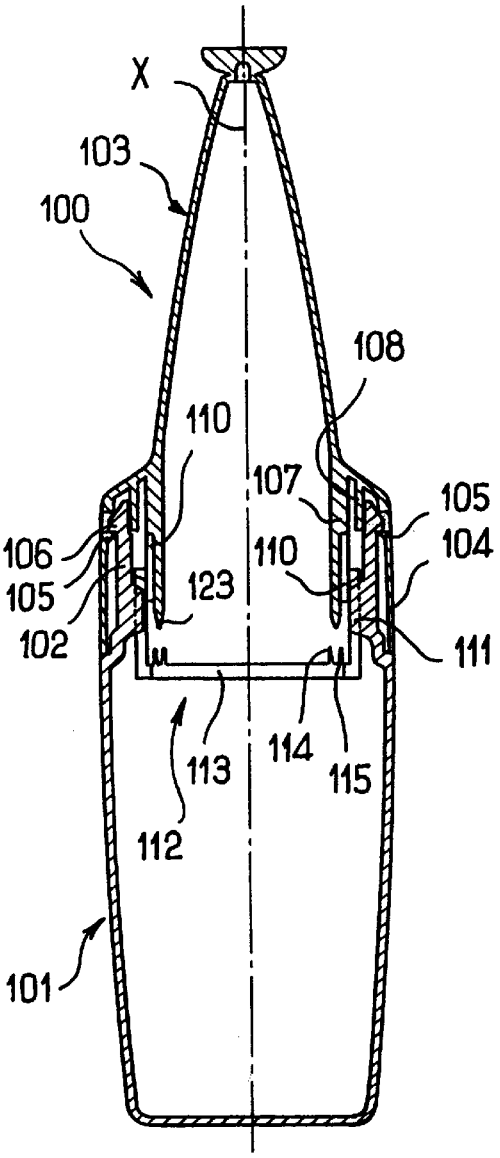
FIGS. 18 and 19 are two longitudinal sections showing a device constituting a fourth embodiment of the invention, respectively before and after the components have been mixed together.
Figure 18:
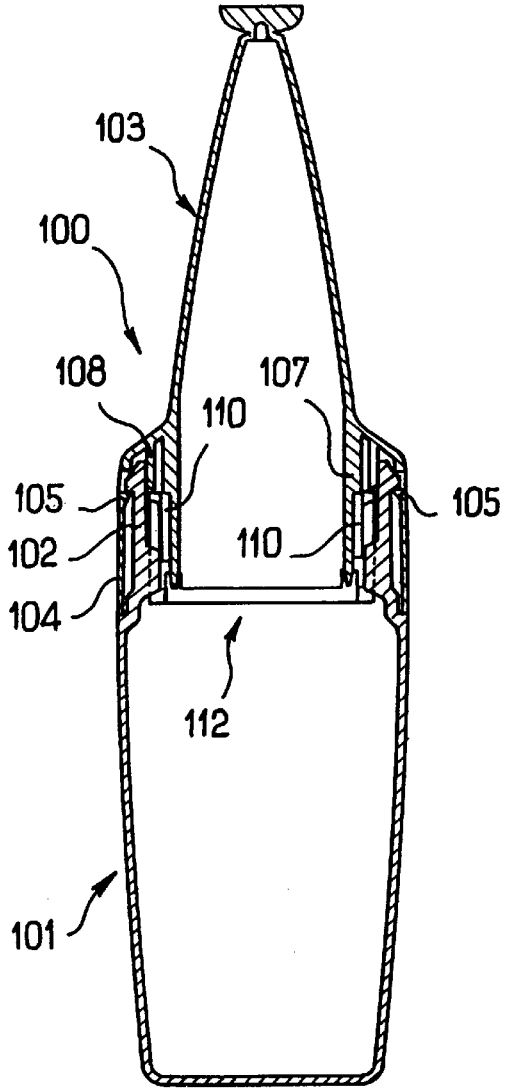
Figure 20:
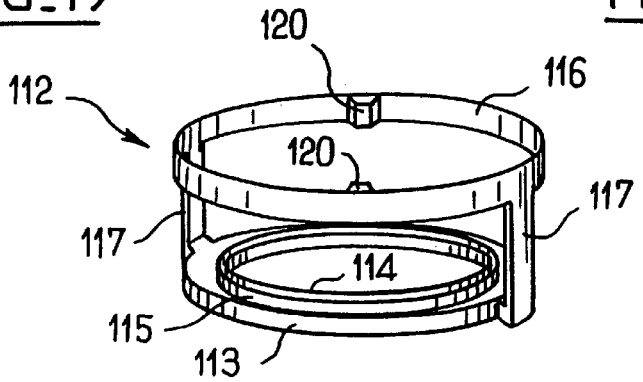
FIG. 20 is a perspective view in isolation of the shutter fitted to the device shown in FIGS. 18 and 19.

FIGS. 18 to 20 show a device 100 constituting a fourth embodiment of the invention.

The device 100 has a lower container 101 with a neck 102, and an upper container 103 in the form of a capsule snap-fastened onto the neck 102.

More particularly, the upper container 103 has an assembly skirt 104 provided with portions in relief 105 that are surmounted by recesses, said portions in relief 105 being designed to snap-fasten on an annular bead 106 formed on the outside surface of the neck 102.

The bottom edge of the skirt 104 bears against a shoulder of the lower container 101 formed at the base of the neck 102 so that the upper container 103 can turn relative to the lower container without moving axially.

The upper container 103 also includes a central chimney 107 situated inside the assembly skirt 104, and an annular sealing lip 108 which extends downwards in the annular space that exists between the assembly skirt 104 and the chimney 107.

The lip 108 bears in sealed manner against the radially inside surface of the neck 102.

The central chimney 107 has two outer threads 110 that are symmetrical to each other about the axis X.

At its base, the neck 102 has two pairs of inwardly projecting bearing surfaces 111 analogous to the bearing surfaces 98 described with reference to FIG. 17.

Before first use of the device 100, the components are separated by a shutter 112 that is shown in isolation in FIG. 20.

The shutter 112 comprises a plug constituted by a disk 113 provided on its upper face with two concentric annular sealing lips 114 and 115 and it also comprises a ring 116 connected to the disk 113 by two diametrically opposite tabs 117.

Two diametrically opposite studs 120 are formed on the radially inner face of the ring 116 to engage in the threads 110.

The tabs 117 are received in grooves formed between the bearing surfaces 111 and they are capable of sliding axially therein.

The bottom end 123 of the chimney 107 engages between the lips 114 and 115 when the shutter 112 is in its initial position before first use of the device, as shown in FIG. 18.

To mix the components, the user turns the upper container 103 relative to the lower container 101.

Since the shutter 112 is prevented from turning relative to the lower container 101, the threads 110 entrain the studs 120 downwards, thereby opening the bottom end of the chimney 107, as shown in FIG. 19, and allowing the components contained in the upper container 103 to move down into the lower container 101.

Naturally, the invention is not limited to the embodiments described above.

In particular, provision can be made for the dispenser endpiece to be carried by the lower container instead of by the upper container as described. It is also possible to provide a device for putting an annular limit on rotation of one of the containers relative to the other.

It will be observed that in the invention the components are mixed at constant volume without any extra pressure being created that might run the risk of causing mixture to be squirted out when the device is opened.

I claim:

1. A device for separately packaging two components to be mixed together on first use, and for dispensing the resulting mixture, the device comprising two superposed containers suitable for communicating with each other via a passage and capable of rotating relative to each other about an axis of rotation without moving axially, a single shutter disposed in said passage to close it during separate storage of the components, one of the containers further including guide means for guiding displacement of the shutter in said passage and the other container including drive means for transforming relative rotation of the two containers into axial displacement of the shutter in said guide means, thereby opening the passage, wherein the shutter further includes retaining means suitable for limiting its displacement in said guide means at the end of relative rotation of the containers.

2. A device according to claim 1, wherein said guide means are shaped to guide the shutter in translation.

3. A device according to claim 2, wherein said guide means include a narrow portion that does not constitute a body of revolution, formed in said passage.

4. A device according to claim 3, wherein said shutter comprises a shank shaped to co-operate with said guide means, and wherein said retaining means are constituted by at least one portion in relief projecting from the end of said shank.

5. A device according to claim 3, wherein said shutter includes a skirt having recesses shaped to co-operate with said guide means, and wherein said retaining means are constituted by the material of the skirt with the exception of said recesses.

6. A device according to claim 2, wherein said guide means include grooves shaped to guide sliding of tabs of the shutter, and wherein said retaining means are constituted by a ring interconnecting said tabs.

7. A device according to claim 1, wherein said drive means comprise at least one thread.

8. A device according to claim 7, wherein said thread is formed by a ring secured to one of the containers.

9. A device according to claim 7, wherein the thread is formed directly by being molded on one of the containers.

10. A device according to claim 1, wherein said drive means comprise a helical ramp shaped to bear progressively against the shutter when the two containers are rotated relative to each other.

11. A device according to claim 1, wherein said shutter includes a compartment designed to contain a third component, and wherein the device further includes in said passage a perforated transverse wall shaped to close said compartment while the shutter is initially in place in said passage.

12. A device according to claim 11, wherein said third component is a perfume or fragrance.

* * * * *